US008444236B2

(12) United States Patent
Netzer

(10) Patent No.: US 8,444,236 B2
(45) Date of Patent: May 21, 2013

(54) DRAWER PULL-OUT GUIDE

(75) Inventor: Emanuel Netzer, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 13/471,802

(22) Filed: May 15, 2012

(65) Prior Publication Data

US 2012/0248956 A1 Oct. 4, 2012

Related U.S. Application Data

(63) Continuation of application No. PCT/AT2010/000423, filed on Nov. 8, 2010.

(30) Foreign Application Priority Data

Dec. 3, 2009 (AT) ..... A 1916/2009

(51) Int. Cl.
*A47B 95/00* (2006.01)
*A47B 88/00* (2006.01)

(52) U.S. Cl.
USPC ..... 312/333; 312/334.7; 312/334.8

(58) Field of Classification Search
USPC 312/333, 330.1, 334.1, 334.6, 334.7–334.43; 384/19–20
See application file for complete search history.

(56) References Cited

U.S. PATENT DOCUMENTS 1,761,303 A * 6/1930 Hunter ..... 312/301
1,926,453 A * 9/1933 Pipe ..... 384/19
2,471,245 A * 5/1949 Shoenberg ..... 312/246
2,496,673 A * 2/1950 Nielsen ..... 312/333
3,131,982 A * 5/1964 Bullock ..... 384/18
3,243,247 A * 3/1966 Knape ..... 312/333
3,973,814 A * 8/1976 Entrikin ..... 312/333
6,039,423 A * 3/2000 Fulterer ..... 312/334.29
7,690,740 B2 * 4/2010 Blum ..... 312/334.45

FOREIGN PATENT DOCUMENTS

AT 364 484 10/1981
AT 387 897 3/1989
AT 390 721 6/1990
AT 408 055 8/2001

(Continued)

OTHER PUBLICATIONS

International Search Report issued Feb. 9, 2011 in International (PCT) Application No. PCT/AT2010/000423.

(Continued)

*Primary Examiner* — Janet M Wilkens
*Assistant Examiner* — Timothy M Ayres
(74) *Attorney, Agent, or Firm* — Wenderoth, Lind & Ponack, L.L.P.

(57) ABSTRACT

A drawer pull-out guide includes a body rail to be fastened to a furniture body and at least one pull-out rail slidably supported relative thereto. The rail is supported so as to be movable between a closed position and an open position. At least one carriage having at least four load-transmitting rolling elements is supported between the rails. The rolling elements run on a runway of a rail, and the runway has a first substantially horizontal, straight guide section in the rear end area and a second substantially horizontal, straight guide section in the front end area. The first and the second guide sections are interconnected by a third guide section that extends downward at an angle from the first to the second guide section.

10 Claims, 6 Drawing Sheets

FOREIGN PATENT DOCUMENTS

Figure 1A:
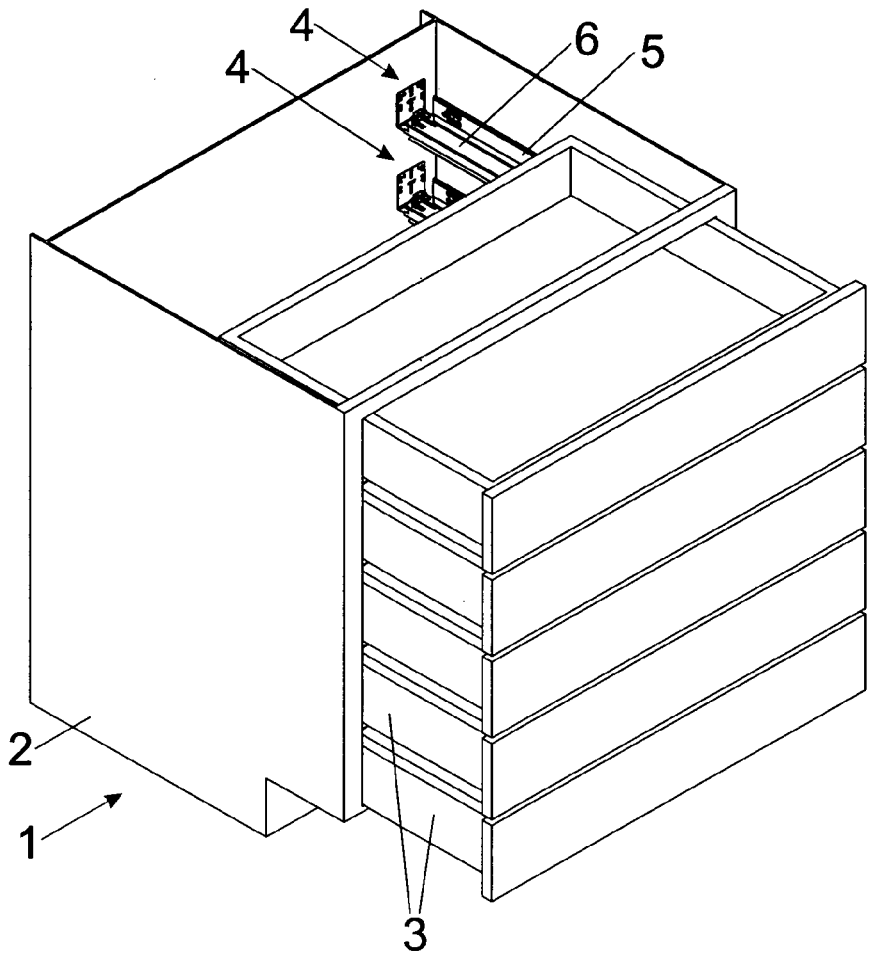

| | | |
|---|---|---|
| AT | 408 059 | 8/2001 |
| AT | 408 410 | 11/2001 |
| DE | 198 39 728 | 3/1999 |
| DE | 198 46 778 | 4/1999 |
| FR | 1 532 775 | 7/1968 |
| GB | 231 365 | 4/1925 |
| GB | 2 168 597 | 6/1986 |

OTHER PUBLICATIONS

Austrian Patent Office Search Report issued Sep. 10, 2010 in Austrian Patent Application No. A 1916/2009.

* cited by examiner

DRAWER PULL-OUT GUIDE

This application is a Continuation of International application No. PCT/AT2010/000423, filed Nov. 8, 2010, the entire disclosure of which is incorporated herein by reference.

The present invention concerns a drawer extension guide comprising a carcass rail to be fastened to a furniture carcass and at least one extension rail which is mounted displaceably relative thereto and which is mounted movably between a closed position and an open position, wherein mounted between the rails is at least one carriage with at least four load-transmitting rolling bodies which run on a runway of a rail.

The invention further concerns an article of furniture comprising at least one drawer which is mounted movably relative to a furniture carcass by way of a drawer extension guide of the kind to be described.

The problem which frequently arises in relation to drawer extension guides of the specified kind is that a drawer can drop down considerably in the fully extended condition and in particular when it is heavily loaded. That dropping movement means that the drawer does not remain in a state of equilibrium, that is to say it can happen that the drawer unintentionally moves into the completely open position, starting from an intermediate position. Because of the dropping effect which has occurred, a user can often only close a drawer which is in the completely open position, with the additional application of manual force, and that can also make the drawer more difficult to operate. In addition drawers which do not drop down or only scarcely drop down in the fully extended position afford a higher-grade visual appearance.

Therefore the object of the invention is to provide a drawer extension guide of the general kind referred to in the opening part of this specification, in which the drop of a drawer connected to the extension guide can be reduced in a structurally simple fashion.

According to the invention that is achieved by the features of claim 1. Further advantageous configurations of the invention are recited in the appendant claims.

According to the invention therefore it is provided that the runway has a first substantially horizontal straight guide portion in the rear end region and a second substantially horizontal straight guide portion in the front end region, wherein the first and second guide portions are connected together by a third guide portion which extends inclinedly downwardly from the first to the second guide portion, wherein in the closed position two rolling bodies are arranged one above the other in the first straight guide portion and in the second straight guide portion respectively, wherein of the rolling bodies arranged one above the other in the first guide portion the lower rolling body is of a larger diameter than the upper rolling body and wherein in the second guide portion the upper rolling body is of a larger diameter than the lower rolling body.

In other words the runway of a rail has in the rear end region a straight first guide portion on which at least two mutually superposed rolling bodies of the carriage are supported in the closed position of the drawer extension guide while at least two further mutually superposed rolling bodies bear against a second straight guide portion, wherein the second guide portion is lowered with respect to the first guide portion.

That difference in level is brought about by a third guide portion which drops downwardly in the extension direction and which connects the first and second guide portions together. The third guide portion can therefore be in the form of an inclinedly extending ramp which when the drawer extension guide is appropriately fitted drops from the rear end region towards the front end region.

Upon opening of an extendable rail the rear end region of that rail is lowered by the inclined guide portion and due to the differing configuration of the rolling body diameters while the front end region of the extendable rail is lifted. When the rail is loaded by the drawer it then again runs approximately on a notional (ideal) horizontal line.

In an embodiment it can be provided that the rolling bodies arranged one above the other are respectively mounted in mutually spaced bearing groups of the carriage. It can also be provided that the rolling bodies arranged one above the other each have a horizontal axis of rotation. The two bearing groups—which are preferably spaced by a bar—can obviously also have still further rolling bodies which guide the bearing group both in the horizontal and also in the vertical direction.

The dimensioning of the diameters of the mutually superposed rolling bodies can be such that the sum of the diameter of the smaller rolling body plus the difference in height of the ramp-shaped third guide portion corresponds to the diameter of the larger rolling body. On the assumption by way of example that the diameter of the smaller rolling body is 4 mm and the difference in height in the ramp is 3 mm, that gives a diameter of 7 mm for the larger rolling body.

The article of furniture according to the invention is characterised by at least one drawer mounted movably relative to a furniture carcass by way of a drawer extension guide of the kind in question.

Figure 1B:
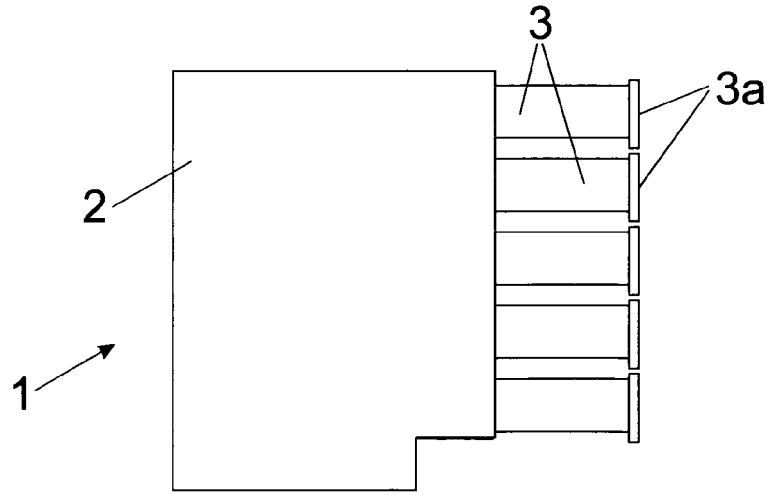
Figure 2:
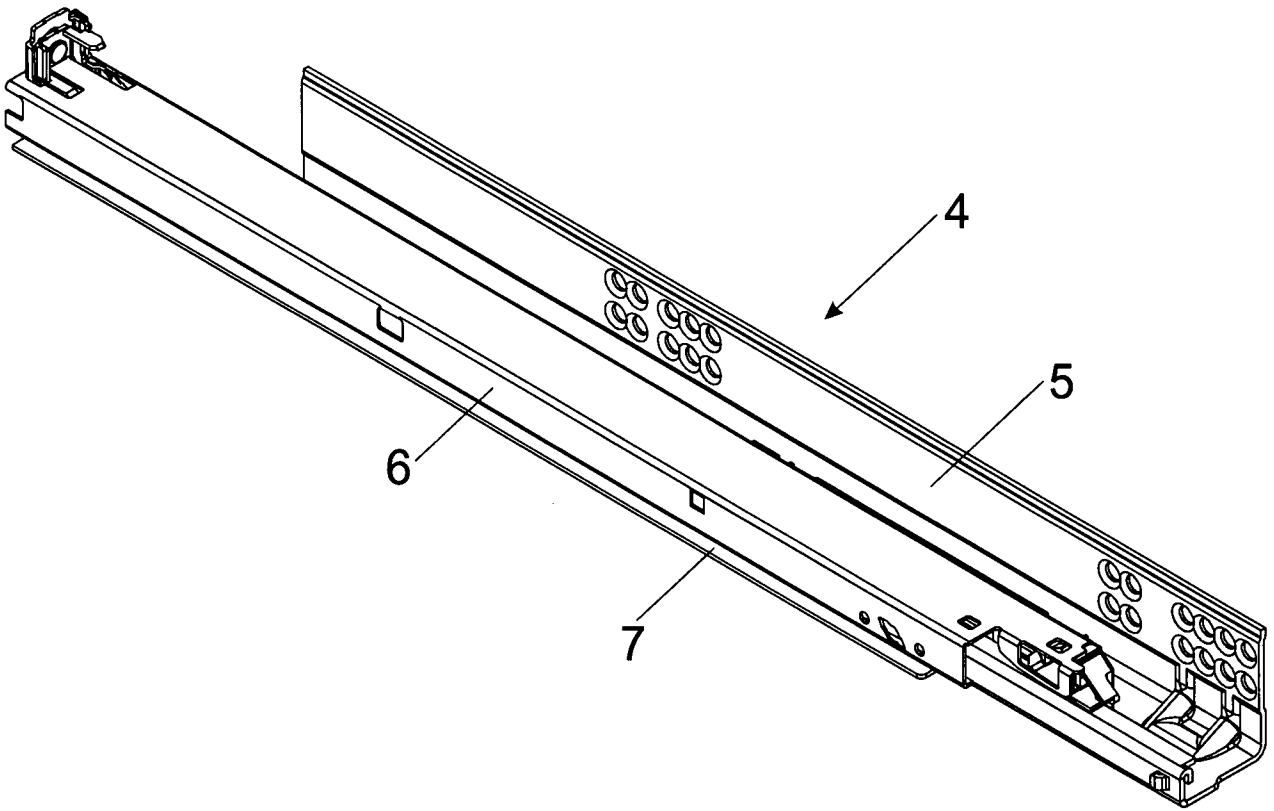
Figure 3:
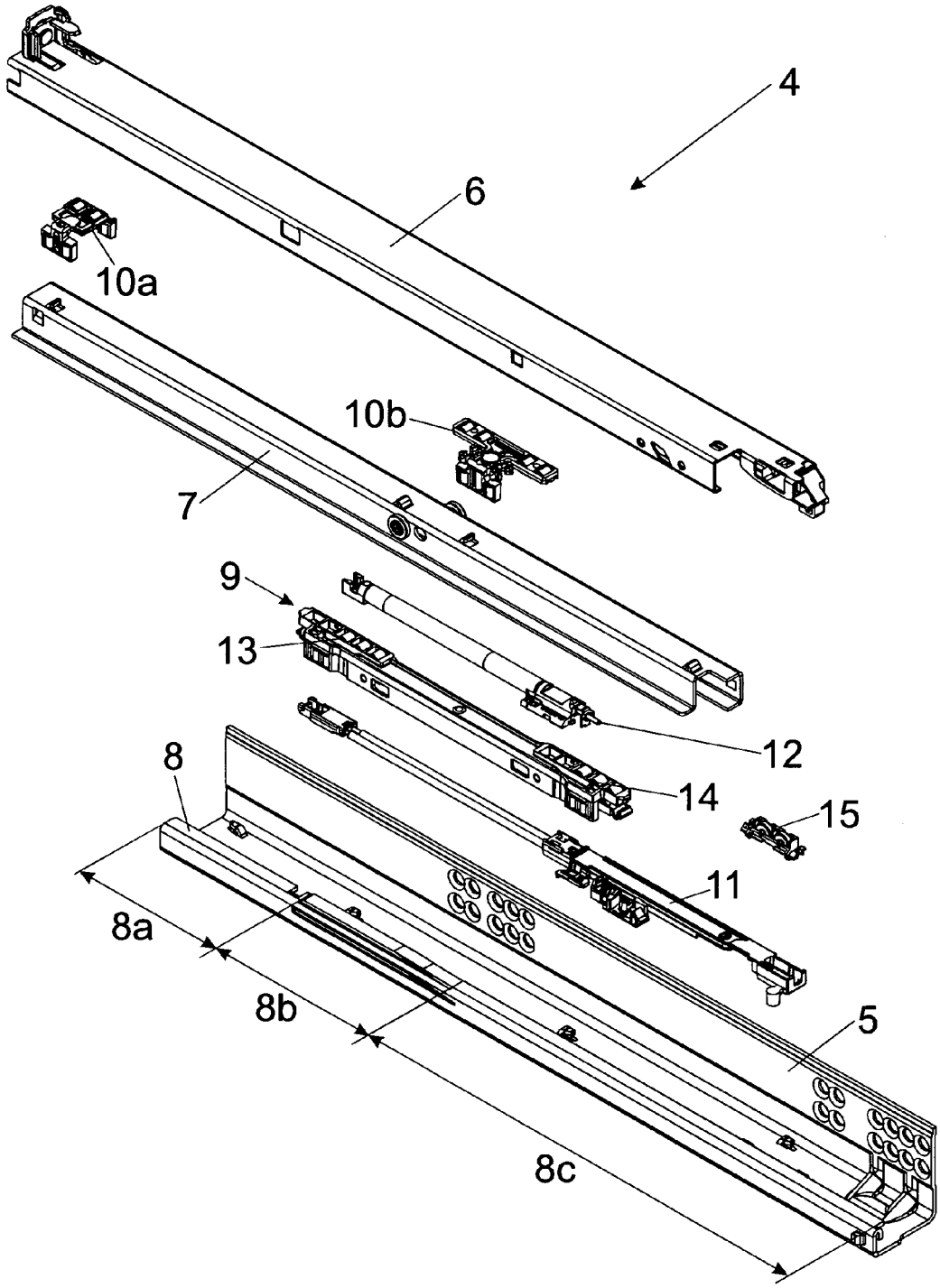
Figure 4A:
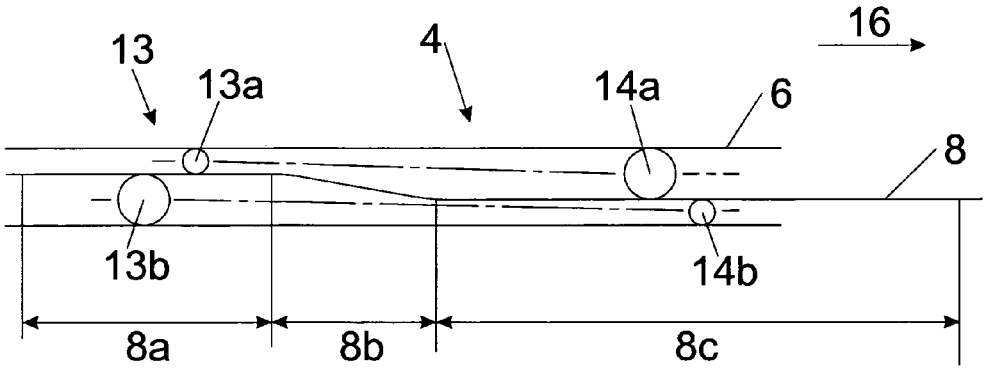
Figure 4B:
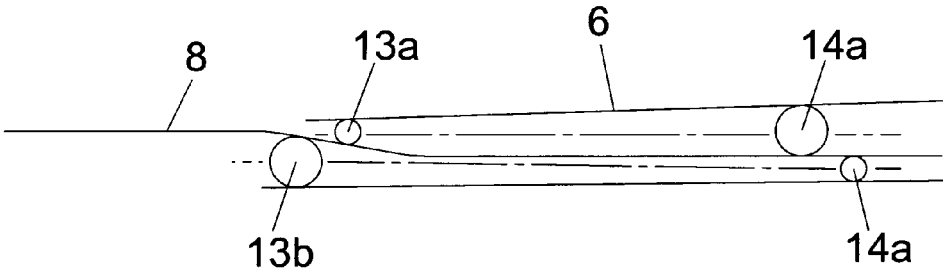
Figure 4C:
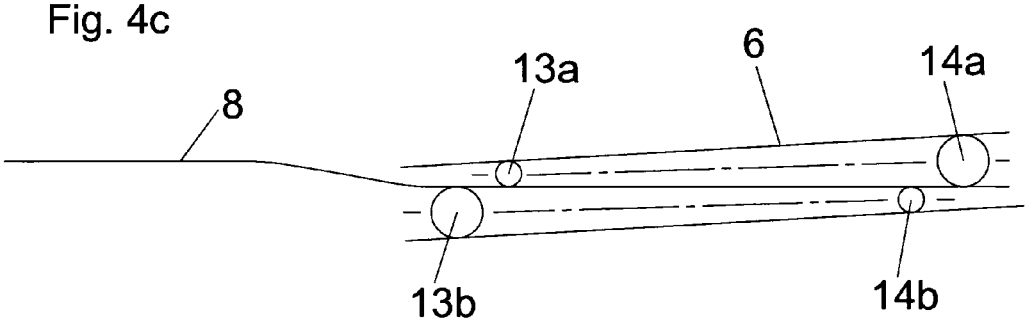
Figure 5A:
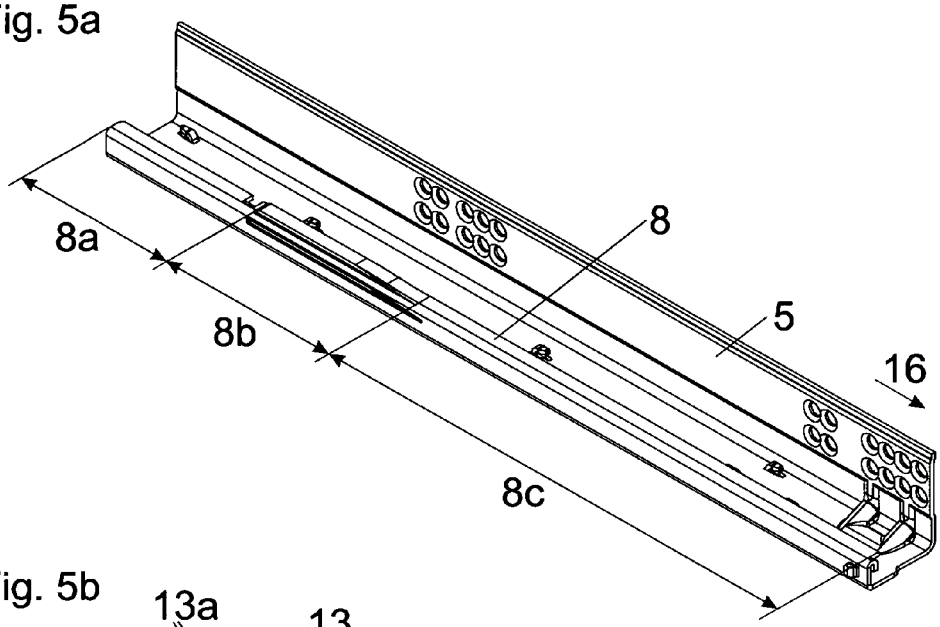
Figure 5B:
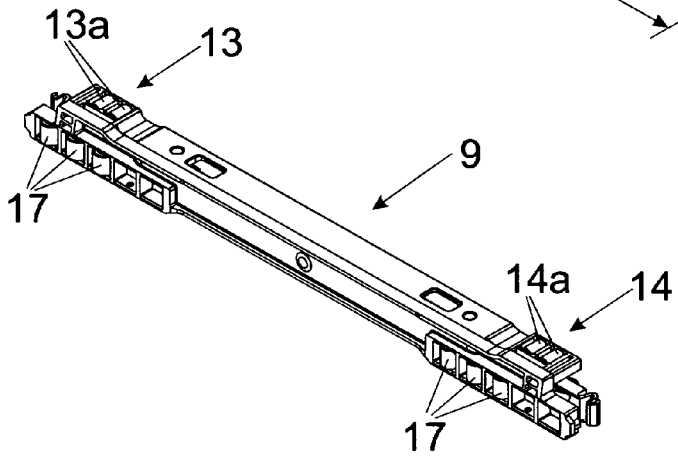
Figure 5C:
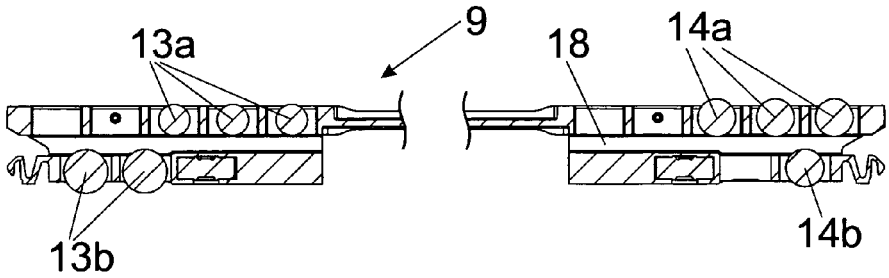
Figure 6A:
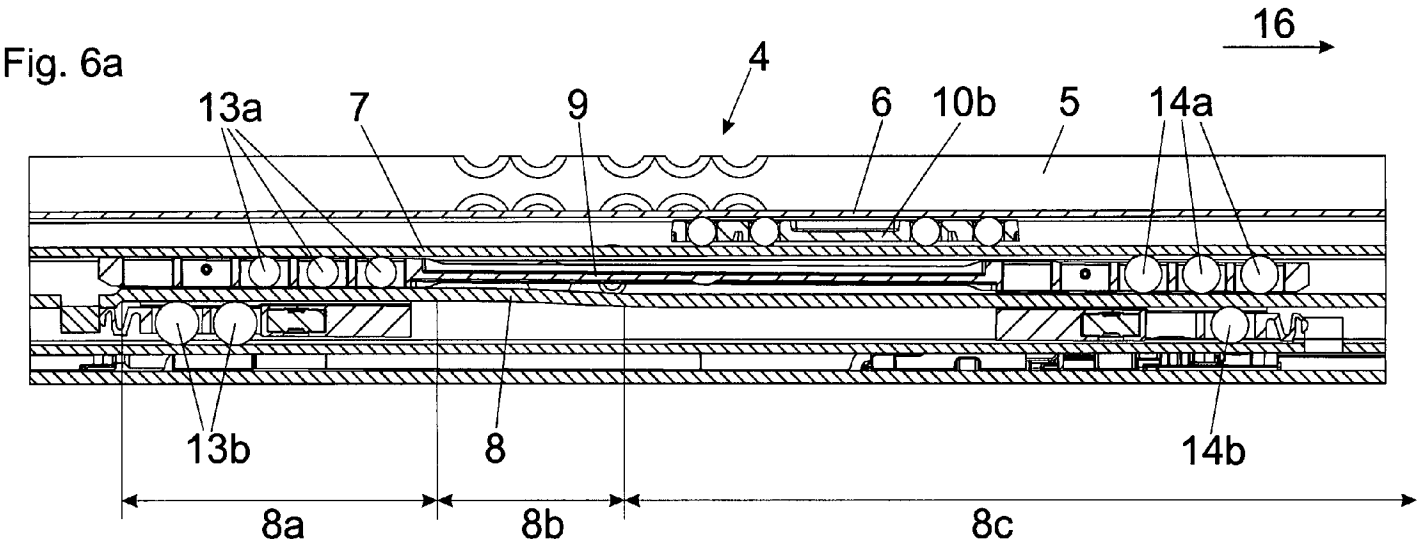
Figure 6B:
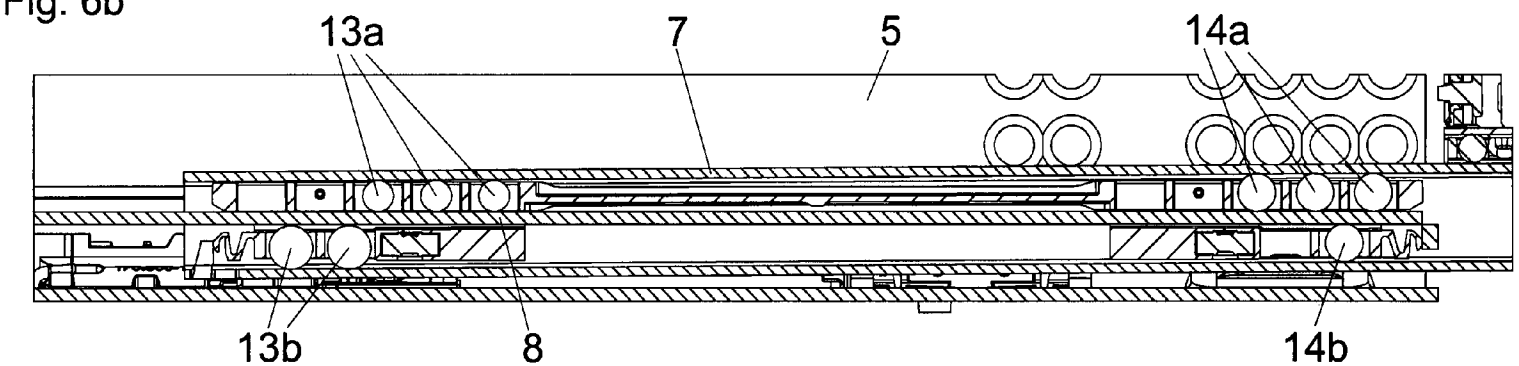

Further details and advantages of the present invention are described with reference to the specific description hereinafter. In the drawing:

FIGS. 1*a* and 1*b* show a perspective view of an article of furniture in the form of a drawer unit with drawers which are mounted displaceably relative to a furniture carcass by way of extension guides according to the invention, and a side view of the article of furniture, FIG. 2 shows a perspective view of a drawer extension guide, FIG. 3 shows an exploded view of the drawer extension guide, FIGS. 4*a* through 4*c* show highly diagrammatic side views of the extension process of a movable rail of the drawer extension guide, FIGS. 5*a* through 5*c* show a perspective view of the carcass rail and a carriage displaceable between the rails as a perspective view and a sectional view, and FIGS. 6*a* and 6*b* show sectional views of the drawer extension guide in the completely closed position and in an open position.

FIG. 1*a* shows a perspective view of an article of furniture 1 having a furniture carcass 2 in the form of a drawer unit, wherein drawers 3 are mounted displaceably relative to the furniture carcass 2 in a substantially horizontal direction by way of drawer extension guides 4. The drawer extension guide 4 includes a carcass rail 5 to be fastened to the furniture carcass 2 and at last one extension rail 6 which is displaceable relative to the carcass rail 5 and which is to be connected to a drawer 3. The drawer extension guide 4 can either be in the form of a two-part rail system comprising a carcass rail 5 and only one extension rail 6 or also in the form of a three-part rail system, in which case an additional displaceable central rail is mounted between the stationary carcass rail 5 and the movable extension rail 6 in order in that way to permit full extension of the drawer 3 relative to the furniture carcass 2.

FIG. 1*b* shows a side view of the article of furniture 1, the drawers 3 being in an open position. The extension stroke movement of the drawers 3 also increases the effective lever arm, with which the weight of a loaded drawer 3 in the fully extended position is transmitted to the rail system by way of the rolling bodies arranged between the rails 5, 6. Under heavy loadings, elastic deformation of the drawer extension guide 4 often occurs, whereby the position of the front panel 3*a* can move downwardly relative to its position in the closed condition. The degree of downward movement of the drawer 3 can be reduced by the drawer extension guide 4 that is still to be described.

FIG. 2 shows a perspective view of a drawer extension guide 4 with the carcass rail 5 to be mounted to the furniture carcass 2 and with the movable extension rail 6 which is to be connected to the drawer 3. Arranged between the carcass rail 5 and the extension rail 6 is a displaceable central rail 7 in order thus to permit full extension of the drawer 3 relative to the furniture carcass 2.

FIG. 3 shows an exploded view of the drawer extension guide 4. The carcass rail 5 to be fastened to the furniture carcass 2 has a runway 8 which extends substantially over the entire length of the rail 5, wherein a carriage 9 with mutually spaced bearing groups 13 and 14—which each have load-transmitting rolling bodies—can run along the runway 8 between a front and a rear end position. The runway 8 of the carcass rail 5 has a first straight guide portion 8*a* in the rear end region and a second straight guide portion 8*c* in the front end region, which are connected together by way of a third guide portion 8*b* which extends inclinedly downwardly. The third guide portion 8*b* of the runway 8 therefore forms a forwardly dropping ramp so that the second guide portion 8*c* is lowered relative to the first guide portion 8*a*. The ratio of the length of the second guide portion 8*c* to the length of the first guide portion 8*a* can be greater than or equal to 4 to 1, preferably greater than or equal to 3 to 1. The ratio of the length of the third guide portion 8*b* to the length of the first guide portion 8*a* can in contrast be equal to or greater than 1 to 1, preferably greater than or equal to 1.5 to 1. The precise function of the bearing groups 13 and 14 which co-operate with the guide portions 8*a*, 8*b*, 8*c* is described in greater detail in the following Figures. The carriage 9 is mounted displaceably between the carcass rail 5 and the central rail 7 while the two upper carriages 10*a*, 10*b* are mounted displaceably between the central rail 7 and the extension rail 6. The two carriages 10*a*, 10*b* also have load-transmitting rolling bodies. The drawer extension guide 4 also includes a per se known pull-in device 11, by which the central rail 7 and/or the extension rail 6 can be engaged just before reaching the completely closed position and can subsequently be pulled into the closed end position. To damp that pull-in movement there is a damping device 12 in the form of a fluid damper, wherein the fluid damper—as in the illustrated embodiment—can be in the form of a fluid cylinder with a displaceable piston therein. Arranged on the carcass rail 5 is a bearing block 15 at which the front end of the extension rail 6 can be supported in the completely closed position.

FIGS. 4*a*-4*c* show highly diagrammatic side views of a drawer extension guide 4 which for reasons of greater clarity is in the form of a two-part rail system, wherein therefore there is a stationary carcass rail 5 and only one extension rail 6 displaceable relative thereto. Of the carcass rail 5, only the runway 8 with the guide portions 8*a*, 8*b* and 8*c* is shown. The carriage 9 which is displaceable between the carcass rail 5 and the extension rail 6 has mutually spaced bearing groups 13, 14 which are each fitted with mutually superposed rolling bodies 13*a*, 13*b* and 14*a*, 14*b*. The rolling bodies 13*a*, 13*b*, like the rolling bodies 14*a*, 14*b*, embrace the runway 8 of the carcass rail 5 so that the lower rolling bodies 13*b*, 14*b* bear against or are supported against the underside of the runway 8 and the upper rolling bodies 13*a*, 14*a* are supported against or bear against the top side of the runway 8. The movable extension rail 6 in turn embraces the rolling bodies 13*a*, 13*b* and 14*a*, 14*b*.

FIG. 4*a* shows the completely closed position of the extension rail 6 which in the closed condition is disposed substantially horizontally. The lower rolling body 13*b* of the left-hand bearing group 13 is of a larger diameter than the upwardly disposed rolling body 13*a* of that bearing group 13 while the upper rolling body 14*a* of the right-hand bearing group 14 is of a larger diameter than the downwardly disposed rolling body 14*b* of that bearing group 14. When now the extension rail 6 is pulled in the extension direction 16, starting from the FIG. 4*a* condition, the lower rolling body 13*b* of the left-hand bearing group 13 goes on to the inclinedly downwardly falling guide portion 8*b* of the runway 8 whereby the rear region of the extension rail 6 is also lowered with respect to the front region of the extension rail 6, as shown in FIG. 4*b*. Upon a further displacement of the extension rail 6 in the opening direction 16 the lower rolling body 13*b* of the left-hand bearing group 13 comes into contact with the underside of the guide portion 8*c* of the runway, wherein the predetermined diameters of the rolling bodies 13*a*, 13*b*, 14*a*, 14*b* cause the extension rail 6 to adopt a further inclined position, as shown in FIG. 4*c*. As naturally the extension rail 6 is also loaded by the weight of the drawer 3 in the fitted condition, that overall results in a substantially horizontal extension movement of the extension rail 6.

FIG. 5*a* shows a perspective view of the carcass rail 5 with the first flat guide portion 8*a* connected to the second flat guide portion 8*c* by way of the ramp-shaped guide portion 8*b*. Reference 16 identifies the extension direction of the drawer 3. FIG. 5*b* shows a perspective view of a carriage 9 with at least two mutually spaced bearing groups 13, 14. It is possible to see the rolling bodies 13*a* and 14*a* displaceable on the top side of the runway 8. In addition each bearing group 13, 14 can have additional rolling bodies 17, the axes of rotation of which deviate at least partly from the horizontal and are preferably vertical.

FIG. 5*c* shows a vertical section through the carriage 9 shown in FIG. 5*b*. It is possible to see mutually superposed rolling bodies 13*a*, 13*b* of the left-hand bearing group 13 and the mutually superposed rolling bodies 14*a*, 14*b* of the right-hand bearing group 14, wherein the mutually diagonal rolling bodies 13*b*, 14*a* can be of the same (larger) diameter. The diameter of the mutually diagonal rolling bodies 13*a*, 14*b* can also be of the same (smaller) diameter. The carriage 9 has a horizontal guide slot 18 for accommodating the runway 8 of the carcass rail 5.

FIG. 6*a* shows a vertical section through the drawer extension guide 4 in the completely closed position. It is possible to see the carcass rail 5 with its runway 8, on which the guide portions 8*a*, 8*b*, 8*c* are provided. In this arrangement the carriage 9 is supported with the upper rolling bodies 13*a* and 14*a* at the top side of the runway 8 while the lower rolling bodies 13*b*, 14*b* bear against the underside of the runway 8. The central rail 7 and the extension rail 6 are mounted substantially horizontally in the closed position. It is possible to see the carriage 10*b* displaceable between the central rail 7 and the extension rail 6 (FIG. 3). Reference 16 identifies the extension direction of the drawer 3.

FIG. 6*b* shows the drawer extension guide 4 in an open position. The lower rolling bodies 13*b* have already left the inclined guide portion 8*b* behind them so that the extendable central rail 7 is lowered because of the differing diameters of the rolling bodies in the rear region so that the front region of the central rail 6 extends in a lifted position. That inclined position of the central rail 7 is compensated again by the weight of the drawer 3 so that overall an approximately horizontal extension movement of the extendable rails 6 and 7 can be implemented.

The present invention is not limited to the illustrated embodiments but includes or extends to all variants and technical equivalents which can fall within the scope of the appended claims. The positional references adopted in the description such as for example up, down, lateral and so forth are also related to the directly described and illustrated Figure and are to be appropriately transferred to the new position upon a change in position.

The invention claimed is:

1. A drawer extension guide comprising a carcass rail to be fastened to a furniture carcass and at least one extension rail which is mounted displaceably relative thereto and which is mounted movably between a closed position and an open position, wherein mounted between the rails is at least one carriage with at least four load-transmitting rolling bodies which run on a runway of a rail, wherein the runway has a first substantially horizontal straight guide portion in the rear end region and a second substantially horizontal straight guide portion in the front end region, wherein the first and second guide portions are connected together by a third guide portion which extends inclinedly downwardly from the first to the second guide portion, wherein in the closed position two rolling bodies are arranged one above the other in the first straight guide portion and in the second straight guide portion respectively, wherein of the rolling bodies arranged one above the other in the first guide portion the lower rolling body is of a larger diameter than the upper rolling body and wherein in the second guide portion the upper rolling body is of a larger diameter than the lower rolling body.

2. A drawer extension guide as set forth in claim 1, wherein the rolling bodies arranged one above the other are respectively mounted in mutually spaced bearing groups of the carriage.

3. A drawer extension guide as set forth in claim 1, wherein the rolling bodies arranged one above the other each have a substantially horizontal axis of rotation.

4. A drawer extension guide as set forth in claim 1, wherein the runway with the first, second and third guide portions is arranged or formed on the carcass rail.

5. A drawer extension guide as set forth in claim 1, wherein the rolling bodies are in the form of rollers, balls, cylindrical rolls and/or disks.

6. A drawer extension guide as set forth in claim 1, wherein a displaceable central rail is arranged between the carcass rail and the extension rail.

7. A drawer extension guide as set forth in claim 6, wherein the runway with the first, second and third guide portions is arranged or formed on the central rail.

8. A drawer extension guide as set forth in claim 1, wherein the ratio of the length of the second guide portion to the length of the first guide portion is equal to or greater than 4 to 1.

9. A drawer extension guide as set forth in claim 1, wherein the ratio of the length of the third guide portion to the length of the first guide portion is equal to or greater than 1 to 1.

10. An article of furniture comprising at least one drawer extension guide as set forth in claim 1.

* * * * *